US008843053B2

(12) United States Patent
Takei

(10) Patent No.: US 8,843,053 B2
(45) Date of Patent: Sep. 23, 2014

(54) IMAGE FORMING APPARATUS WITH SUCTION UNIT CONTROLLER

(75) Inventor: Yuhei Takei, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 1278 days.

(21) Appl. No.: 11/780,075

(22) Filed: Jul. 19, 2007

(65) Prior Publication Data

US 2008/0031669 A1 Feb. 7, 2008

(30) Foreign Application Priority Data

Aug. 3, 2006 (JP) ..... 2006-212613

(51) Int. Cl.
*G03G 15/00* (2006.01)

(52) U.S. Cl.
CPC .... *G03G 15/657* (2013.01); *G03G 2215/00409* (2013.01)
USPC ..... 399/397; 399/400

(58) Field of Classification Search
CPC ..... G03G 15/657; G03G 2215/00409; G03G 21/14; G03G 2215/00573; G03G 2215/00413; B65H 5/02; B65H 5/224; B65H 2406/3222; B65H 5/085; B65H 5/021
USPC ..... 399/397, 400
See application file for complete search history.

(56) References Cited

U.S. PATENT DOCUMENTS

| | | | | |
|---|---|---|---|---|
| 4,952,982 | A * | 8/1990 | Tabuchi | 399/22 |
| 5,132,737 | A * | 7/1992 | Takeda et al. | 399/303 |
| 5,210,573 | A * | 5/1993 | Fukuchi et al. | 399/111 |
| 6,154,621 | A * | 11/2000 | Yamamoto et al. | 399/68 |
| 6,192,205 | B1 * | 2/2001 | Motohashi | 399/66 |
| 6,580,884 | B2 | 6/2003 | Kuwabara | 399/92 |
| 2004/0240917 | A1 * | 12/2004 | Ando et al. | 399/400 |

FOREIGN PATENT DOCUMENTS

| | | |
|---|---|---|
| JP | 8-110738 | 4/1996 |
| JP | 8-310686 | 11/1996 |
| JP | 11174768 A * | 7/1999 |
| JP | 2002-258722 | 9/2002 |
| JP | 2005-316184 | 11/2005 |

* cited by examiner

*Primary Examiner* — Jill Culler
*Assistant Examiner* — Jennifer Simmons
(74) *Attorney, Agent, or Firm* — Fitzpatrick, Cella, Harper & Scinto

(57) ABSTRACT

Provided is an image forming apparatus including: an image carrying unit on which a toner image is carried; a transfer unit that transfers a toner image carried by the image carrying unit onto a sheet at a transferring position; a sheet conveyor unit that conveys the sheet having the toner image transferred thereto by the transfer unit; a suction device that sucks the sheet to the sheet conveyor unit; and a controller that stops or reduces a sucking operation of the suction device where the toner image carried by the image carrying unit passes the transferring position without being transferred onto the sheet.

12 Claims, 10 Drawing Sheets

IMAGE FORMING APPARATUS WITH SUCTION UNIT CONTROLLER

BACKGROUND OF THE INVENTION

1. Field of the Invention

The present invention relates to an image forming apparatus for forming an image on a sheet.

2. Description of the Related Art

As a conventional image forming apparatus such as a copying machine, a printer, or a facsimile, there is one having a structure in which a toner image formed on a photosensitive drum is primarily transferred onto an endless intermediate transfer belt and is then secondarily transferred onto the sheet. In addition, a sheet transport apparatus for transporting the sheet having the toner image secondarily transferred thereto to a fixing portion is provided between a secondary transfer portion for secondarily transferring the toner image onto the sheet, and the fixing portion for fixing the toner image onto the sheet.

As the sheet transport apparatus, there is one which includes a conveyor belt, a roller for driving the conveyor belt, and a fan for attaching the sheet to the conveyor belt, and transports the sheet having the toner image transferred thereto to the fixing portion while adsorbing the sheet (for example, see Japanese Patent Application Laid-Open No. 2005-316184).

FIG. 8 is a diagram illustrating a structure of a related sheet transport apparatus. A sheet transport apparatus 200 includes an endless sheet conveyor belt 201 which is suspended over multiple rollers 203 and has flexibility, and a fan 202 provided inside the sheet conveyor belt, for attracting a sheet.

In FIG. 8, a toner image formed on a photosensitive drum (not shown) is primarily transferred onto an intermediate transfer belt 211, and a second transfer portion 210 transfers a toner image T formed on the intermediate transfer belt 211 onto the sheet.

In a case where the sheet passing through the secondary transfer portion 210 and having the toner image secondarily transferred thereto is transported to a fixing portion (not shown), the sheet conveyor belt 201 is rotated in a direction of the fixing portion while the sheet is adsorbed to the sheet conveyor belt 201 by the fan 202. When a full-color image is formed, the intermediate transfer belt 211 is first rotated multiple times, and then the toner images T for each color are sequentially superposed on the intermediate transfer belt, thereby forming a full-color toner image T. After that, the full-color toner image T is secondarily transferred onto the sheet from the intermediate transfer belt 211.

In order to reliably adsorb and transport the sheet in the sheet transport apparatus and the image forming apparatus, it is necessary to increase an adsorbability (suction force) of the fan 202. However, in a case where the adsorbability of the fan 202 is increased, an air flow from the sheet conveyor belt 201 to the fan 202 is generated.

Particularly in a case of forming a full-color image, when the toner images T sequentially superposed on the intermediate transfer belt 211 reach a position at which the toner images T face the fan 202 before the toner images T are transferred onto the sheet as illustrated in FIG. 8, the toner images T may be scattered from the intermediate transfer belt 211 by the air flow. When the toner images T are scattered from the intermediate transfer belt 211, a sheet transport path may be contaminated, and the sheet is also contaminated when the sheet is transported. When the toner images T are scattered from the intermediate transfer belt 211, an image quality is degraded.

Japanese Patent Application Laid-Open No. H08-310686 discloses a structure in which a fan for adsorbing a sheet to a conveyor belt is stopped/driven according to a position of the sheet to be transported. In the structure disclosed in Japanese Patent Application Laid-Open No. H08-310686, noise due to a change of the attraction, which is caused when a trailing edge of the sheet passes through an adsorbing portion, is prevented from generating by stopping a sheet adsorbing operation before the trailing edge of the sheet passes through an adsorbing unit. In the structure disclosed in Japanese Patent Application Laid-Open No. H08-310686, the above-mentioned problem in that the toner image is scattered when the toner image formed on an image bearing member faces the conveyor belt is not taken into consideration. In the structure disclosed in Japanese Patent Application Laid-Open No. 08-310686, the toner image developed on the photosensitive drum serving as the image bearing member is immediately transferred onto the sheet by the transfer portion. Accordingly, the toner image formed on the photosensitive drum is not in a state of facing the conveyor belt.

Japanese Patent Application Laid-Open No. H08-110738 discloses a structure in which a fan for ventilation of the apparatus main body is turned up during a time when formation of an image on the sheet is not performed, and is turned down during image formation. In a case of operating the fan for ventilation during image formation, the fan can be driven with only a small power which does not affect the image formation. Accordingly, in the structure disclosed in Japanese Patent Application Laid-Open No. H08-110738, in consideration of the fact that the ventilation by the fan for ventilation when the fan is insufficient with such a small power that does not affect the image formation, the exhaust fan is strongly driven during a time when the image formation is not performed. In the structure disclosed in Japanese Patent Application Laid-Open No. H08-110738, the above-mentioned problem in that the toner image is scattered when the toner image formed on the image bearing member faces the conveyor belt is not taken into consideration. In the structure disclosed in Japanese Patent Application Laid-Open No. H08-110738, because the toner image developed on the photosensitive drum serving as the image bearing member is immediately transferred onto the sheet by the transfer portion, the toner image formed on the photosensitive drum is not in a state of facing the conveyor belt.

Japanese Patent Application Laid-Open No. 2002-258722 discloses a structure in which disturbance of toner particles on a sheet is prevented by turning down or stopping a cooling fan which is used for preventing temperature rise within the apparatus due to heat generated from the fixing device when the leading edge of the sheet having an image formed thereon is present between the transfer portion and the fixing device. In the structure disclosed in Japanese Patent Application Laid-Open No. 2002-258722, an effect on the toner on the sheet due to the fan for preventing temperature rise within the apparatus is taken into consideration. However, the problem in that the toner image is scattered when the toner image formed on the image bearing member faces the conveyor belt is not taken into consideration.

SUMMARY OF THE INVENTION

The present invention has been made in view of the above-mentioned circumstances, and the present invention provides a sheet transport apparatus and an image forming apparatus capable of transporting a sheet in a state where a toner image is hardly scattered.

According to the preset invention, there is provided an image forming apparatus including: an image carrying unit on which a toner image is carried; a transfer unit that transfers a toner image carried by the image carrying unit onto a sheet at a transferring position; a sheet conveyor unit that conveys the sheet having the toner image transferred thereto by the transfer unit; a suction device that sucks the sheet to the sheet conveyor unit; and a controller that stops or reduces a sucking operation of the suction device where the toner image carried by the image carrying unit passes the transferring position without being transferred onto the sheet.

According to the present invention, it is possible to reduce scattering of the toner image formed on the image bearing member.

Further features of the present invention will become apparent from the following description of an exemplary embodiment (with reference to the attached drawings).

DESCRIPTION OF THE EMBODIMENT

Hereinafter, an exemplary embodiment for carrying out the present invention will be described in detail with reference to the drawings.

Figure 1:
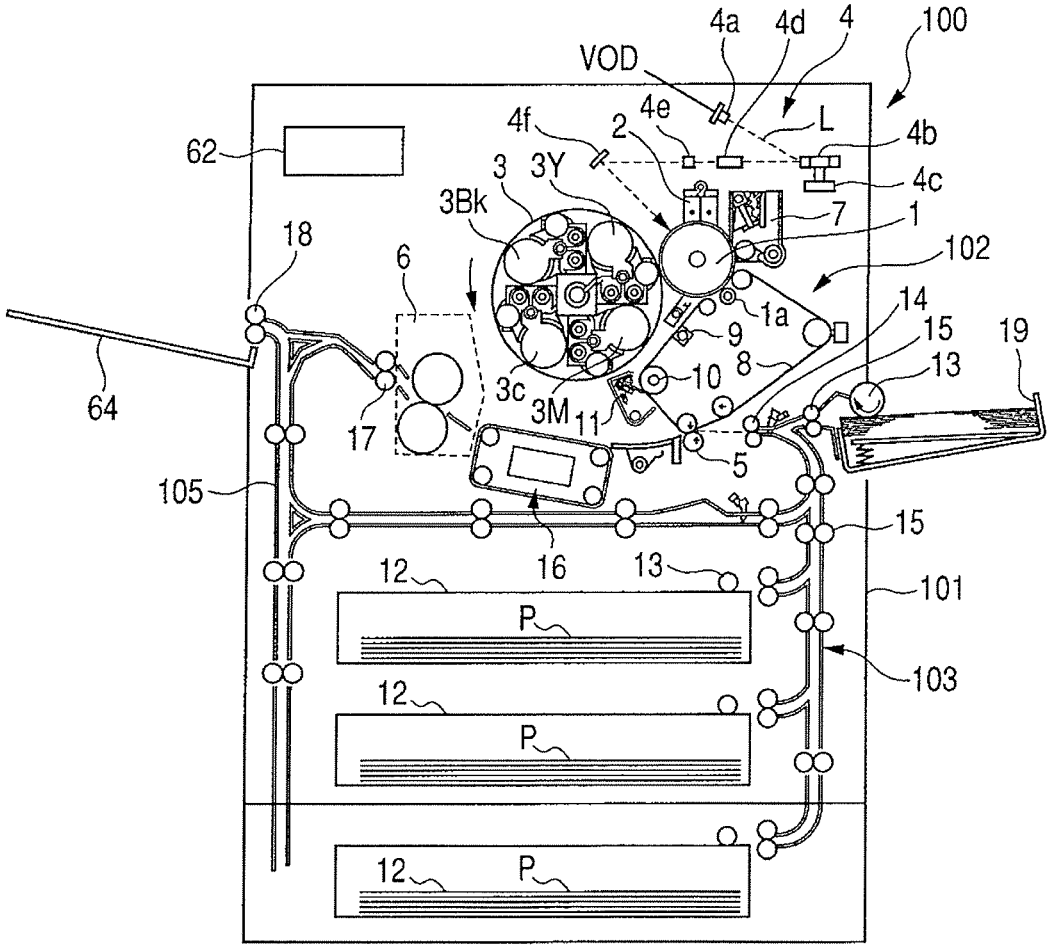
FIG. 1 schematically illustrates a color laser printer which is an example of an image forming apparatus including a sheet transport apparatus according to an embodiment of the present invention.

FIG. 1 is a diagram schematically illustrating a color laser printer which is an example of an image forming apparatus including a sheet transport apparatus according to an embodiment of the present invention.

In FIG. 1, a color laser printer main body (hereinafter, referred to as "apparatus main body") 101 of a color laser printer (image forming apparatus) 100 includes an image forming portion 102, a sheet feeding portion 103 for feeding a sheet P to the image forming portion 102, a fixing portion 6, and a conveyor belt unit 16 which is an example of a sheet transport apparatus for transporting a sheet having an unfixed full-color toner image transferred thereto, to the fixing portion 6. The conveyor belt unit 16 transports a sheet through rotation of a sheet conveyor belt 31 in a state where the sheet is adsorbed to the sheet conveyor belt by a conveying fan 30 (see FIG. 2). A structure of the conveyor belt unit 16 will be described later.

The image forming portion 102 includes a cylindrical photosensitive drum 1, a primary charger 2, a rotary developing device 3 having multiple developing devices 3Y, 3M, 3C, and 3Bk each being integrated with a toner cartridge. The image forming portion 102 includes an endless intermediate transfer belt (image carrying unit) 8 onto which four color toner images sequentially formed on the photosensitive drum 1 are sequentially primarily transferred, and a secondary transfer roller 5 for secondarily transferring the toner images primarily transferred onto the intermediate transfer belt 8 onto the sheet P.

An exposure system 4 includes a laser unit 4*a* for emitting a laser beam L and on/off modulating by an image signal (VDO signal) to be described later, and a polygon mirror 4*b* used for horizontal scanning by the laser beam L. The exposure system 4 further includes a scanner motor 4*c* for rotating the polygon mirror 4*b* at low speed, an fθ lens 4*d* for imaging the laser beam L, a photodetector 4*e* for detecting a BD signal indicating a start point of the horizontal scanning, and a reflection mirror 4*f* for guiding the laser beam L to the photosensitive drum 1.

The sheet feeding portion 103 includes cassettes 12 that contains sheets P and is detachably mounted onto the apparatus main body 101, and a manual feed cassette 19. The sheets P are supplied to the image forming portion 102 from the cassettes 12 and the manual feed cassette 19. On an upstream side of the image forming portion 102, there is provided a registration roller 14 for enhancing a posture position accuracy of the sheet P and for feeding the sheet P at an appropriate timing for the toner image formed on the transfer belt.

A detector 9 detects a detection target provided at a predetermined position on the intermediate transfer belt 8. The detector 9 outputs a reference signal which is determined in consideration of a transfer position when the toner image formed on the photosensitive drum 1 is transferred onto the intermediate transfer belt 8, and which is a trigger of a start of image formation by the laser unit 4*a*.

Figure 10:
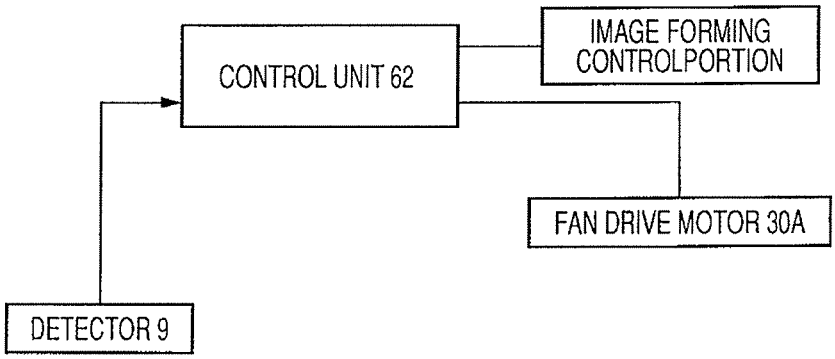
FIG. 10 illustrates a control block diagram of the color laser printer.

In FIG. 10 which is a block diagram of the control of the apparatus main body, a control unit (control means) 62 controls the entire image forming operation of the apparatus main body 101. The control unit 62 is connected to the detector 9. A detection result obtained by the detector 9 is input to the control unit 62. The control unit 62 is connected to an image forming control portion for controlling each of the image forming portion 102 and the sheet feeding portion 103, and controls each of the image forming portion 102 and the sheet feeding portion 103 through the image forming control portion. The control unit 62 is connected to a fan drive motor 30A for driving the conveying fan 30 of the conveyor belt unit 16. The control unit 62 controls drive of the fan drive motor 30A.

The control unit 62 outputs the image signal (VDO signal) to the exposure system 4 in synchronization with a reference signal (TOP signal) from the detector 9. In other words, the detector 9 detects the detection target provided at the predetermined position on the intermediate transfer belt 8, and transmits the TOP signal to the control unit 62. The control unit 62 having received the TOP signal transmits the image signal (VDO signal) to the exposure system 4. The photosensitive drum 1 is subjected to scanning exposure by the laser beam L emitted from the laser unit 4*a* and on/off modulated by the image signal (VDO signal), thereby forming an electrostatic latent image corresponding to the image signal on the photosensitive drum 1.

Next, an operation of the image forming apparatus 100 will be described.

When an image forming signal is output from the control unit 62 provided to the apparatus main body 101, an image signal (VDO signal) from, for example, an image reading portion or a personal computer (not shown) is input to the exposure system 4 in synchronization with the reference signal (TOP signal) from the detector 9.

In the exposure system 4, the laser beam L is radiated from the laser unit 4*a* in response to the image signal (VDO signal), and the horizontal scanning by the laser beam L is performed using the polygon mirror 4*b*. After that, the laser beam L passes through the fθ lens 4*d* and the reflection mirror 4*f*, and the photosensitive drum 1 is radiated with the laser beam L. At this time, the detector 4*e* detects the signal (BD signal) indicating the start point of the horizontal scanning by exposure, thereby performing exposure in synchronization with the BD signal.

At this time, the photosensitive drum 1 is charged with a predetermined polarity and a predetermined voltage in advance by the primary charger 2, and is radiated with the laser beam L, thereby forming the electrostatic latent image on a surface of the photosensitive drum 1. Then, a toner image for a selected color is formed by the multiple developing devices 3Y, 3M, 3C, and 3Bk provided in the rotary developing device 3. After that, the toner image formed on the photosensitive drum is primarily transferred onto the intermediate transfer belt 8 by a primary transfer roller 1*a* at the prescribed transfer position.

In a case of a full-color mode, first, in synchronization with the reference signal (TOP signal) from the detector 9, the control unit 62 inputs an image signal (VDO signal) related to yellow to the exposure system 4 so as to form an electrostatic latent image related to yellow on the photosensitive drum 1. In order to develop the electrostatic latent image related to yellow which is formed on the photosensitive drum 1, the yellow developing device 3Y is placed at a position opposing the photosensitive drum 1. By the yellow developing device 3Y, the yellow toner image, which is a first color, is formed on the photosensitive drum 1. The yellow toner image is primarily transferred onto the intermediate transfer belt 8 by application of a transfer bias voltage with a polarity opposite to that of the toner, to the primary transfer roller 1*a*.

After that, the intermediate transfer belt 8 having the yellow toner image transferred thereto further rotates so that a subsequent toner image is primarily transferred thereto. During that time, the rotary developing device 3 is caused to rotate in a counterclockwise direction so that the developing device 3M for magenta, which is a subsequent color, faces the photosensitive drum 1.

Subsequently, an image signal (VDO signal) related to magenta is input to the exposure system 4 so as to form an electrostatic latent image related to magenta on the photosensitive drum 1. The control unit 62 inputs the image signal to the exposure system 4 at a timing after the elapse of a predetermined time after receiving the reference signal (TOP signal) from the detector 9.

The predetermined time is set as a time for superimposing the magenta toner image, which is to be primarily transferred, on the yellow toner image formed on the intermediate transfer belt 8, based on a circumferential speed of the photosensitive drum 1, a peripheral length of the photosensitive drum 1 from a point at which the laser beam is radiated from the laser unit 4*a*, to the primary transfer portion, and based on a circumferential speed and a peripheral length of the intermediate transfer belt 8. In other words, it is possible to obtain a position of a toner image formed on the intermediate transfer belt 8 according to the elapse of time from a time when the reference signal (TOP signal) from the detector 9 is transmitted, based on the circumferential speed of the photosensitive drum 1, a rotational speed of the intermediate transfer belt 8, and the like. After the elapse of the time which is set as the time for superimposing the magenta toner image to be primarily transferred, on the yellow toner image formed on the intermediate transfer belt 8, after the reference signal (TOP signal) from the detector 9 is received, the control unit 62 inputs the image signal to the exposure system 4 to thereby cause the laser unit 4*a* to start latent image formation.

The magenta electrostatic latent image formed on the photosensitive drum 1 is developed on the photosensitive drum 1 by the magenta developing device 3M. The toner image for magenta, which is the second color, developed on the photosensitive drum 1 is primarily transferred onto the transfer belt 8 by the primary transfer roller 1*a* so that the magenta toner image is superimposed on the yellow toner image formed on the intermediate transfer belt 8.

The intermediate transfer belt 8 to which the yellow toner image and the magenta toner image are transferred further rotates so that the subsequent toner image is primarily transferred thereto. During that time, the rotary developing device 3 causes the developing device 3C for cyan, which is a subsequent color, to rotate in a counterclockwise direction so that the developing device 3C faces the photosensitive drum 1.

The control unit 62 inputs an image signal (VDO signal) related to cyan to the exposure system 4 so as to form an electrostatic latent image related to cyan on the photosensitive drum 1. The control unit 62 inputs the image signal to the exposure system 4 at a timing after the elapse of a predetermined time which is set as a time for superimposing the cyan toner image to be primarily transferred, on the yellow toner image and the magenta toner image that are formed on the intermediate transfer belt 8 after the reference signal (TOP signal) from the detector 9 is received.

The cyan electrostatic latent image formed on the photosensitive drum 1 is developed on the photosensitive drum 1 by the cyan developing device 3C. The toner image for cyan, which is the third color, developed on the photosensitive drum 1 is primarily transferred onto the intermediate transfer belt 8 by the primary transfer roller 1*a* so that the cyan toner image is superimposed on the yellow toner image and the magenta toner image that are formed on the intermediate transfer belt 8.

The intermediate transfer belt 8 having the yellow toner image, the magenta toner image, and the cyan toner image transferred thereto further rotates so that the subsequent toner image is primarily transferred thereto. During that time, the rotary developing device 3 causes the developing device 3Bk for black, which is the subsequent color, to rotate in a counterclockwise direction so that the developing device 3Bk faces the photosensitive drum 1.

The control unit 62 inputs an image signal (VDO signal) related to black to the exposure system 4 so as to form an electrostatic latent image related to black on the photosensitive drum 1. The control unit 62 inputs the image signal to the exposure system 4 at a timing after the elapse of a predetermined time which is set as a time for superimposing the black toner image to be primarily transferred, on the yellow toner image, the magenta toner image, and the cyan toner image that are formed on the intermediate transfer belt 8 after the reference signal (TOP signal) from the detector 9 is received.

The black electrostatic latent image formed on the photosensitive drum 1 is developed on the photosensitive drum 1 by the black developing device 3Bk. The toner image for black, which is the fourth color, developed on the photosensitive drum 1 is primarily transferred onto the intermediate transfer belt 8 by the primary transfer roller 1*a* so that the black toner image is superimposed on the yellow toner image, the magenta toner image, and the cyan toner image that are formed on the intermediate transfer belt 8.

As described above, in the full-color mode, formation of an electrostatic latent image, development, and primary transfer are repeated until the four color toner images are transferred onto the intermediate transfer belt 8, thereby forming a full-color toner image, which is obtained by superimposing four colors, on the intermediate transfer belt 8.

On the other hand, the control unit 62 causes a sheet feed roller 13 and a transport roller 15, which are provided to the sheet feeding portion 103, to rotate in response to the reference signal (TOP signal) from the detector 9 serving as a detecting unit, thereby feeding the sheet P from the cassettes 12 or the manual feed cassette 19. After that, a skew of the sheet P fed from the sheet feeding portion 103 is corrected by the registration roller 14, and the sheet P is transported to a secondary transfer portion which includes the intermediate transfer belt 8 and the secondary transfer roller 5 at an appropriate timing for the toner image formed on the intermediate transfer belt 8.

Then, the full-color toner image formed on the intermediate transfer belt 8 is secondarily transferred onto the sheet P, which is fed to the secondary transfer portion, by the secondary transfer roller 5, and then the sheet P is transported to the fixing portion 6 by the conveyor belt unit 16. After that, an unfixed transfer image is permanently fixed onto the sheet P through heating and pressurization by the fixing portion 6. The sheet P having the image thus fixed thereon is delivered onto a delivery tray 64 from the apparatus main body 101 by a transport roller 17 and a delivery roller 18.

In a case where the image forming apparatus 100 has a duplex image forming function and images are formed on both surfaces of the sheet, after completion of a fixing process on a first surface of the sheet by the fixing portion 6, the sheet P is transported to the image forming portion 102 again through a reversing and conveying path 105. Then, with respect to the sheet P which is transported again to the image forming portion 102, the toner image is formed on a second surface of the sheet P by the above-mentioned imaging process.

Residual toner on the surface of the photosensitive drum 1 which has finished transfer of the toner image onto the intermediate transfer belt 8, and on the surface of the intermediate transfer belt 8 which has finished transfer of the toner image onto the sheet P, is removed by cleaning devices 7 and 11 each having a blade-like cleaning member.

Figure 2:
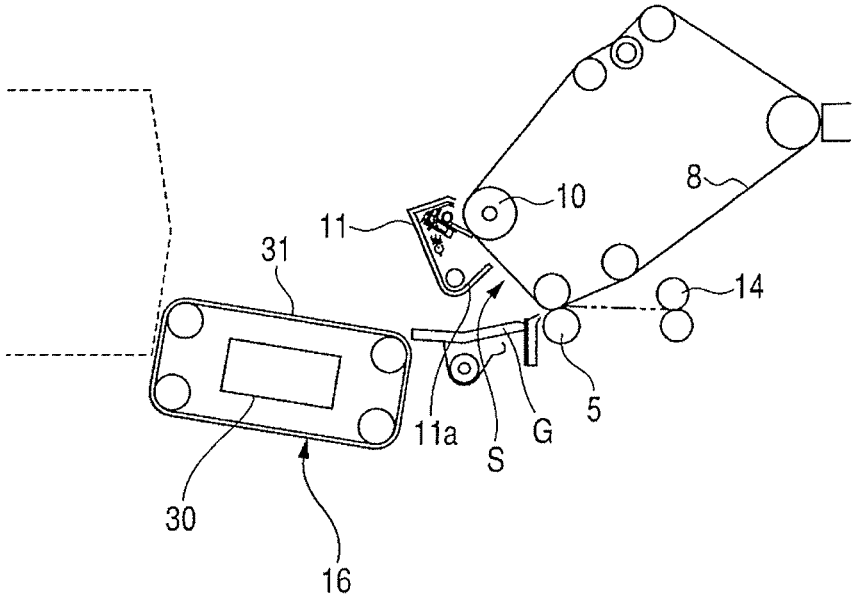
FIG. 2 illustrates a structure of the color laser printer in the vicinity of a conveyor belt unit which is an example of the sheet transport apparatus.

FIG. 2 is a diagram illustrating a structure of the color laser printer in the vicinity of the conveyor belt unit 16. In FIG. 2, a carrying space S is provided between a lower surface 11*a* of the cleaning device 11, and a conveying guide G provided at a downstream of the secondary transfer portion. The sheet P obtained after the secondary transfer is transported to the conveyor belt unit 16 through the carrying space S.

A part of the peripheral surface of the intermediate transfer belt 8 faces the carrying space S. For example, in a case where the full-color toner image is formed on the intermediate transfer belt 8, when the intermediate transfer belt 8 having the first to third color toner images transferred thereto rotates, the toner images formed on the intermediate transfer belt 8 are carried while facing the carrying space S.

Figure 3:
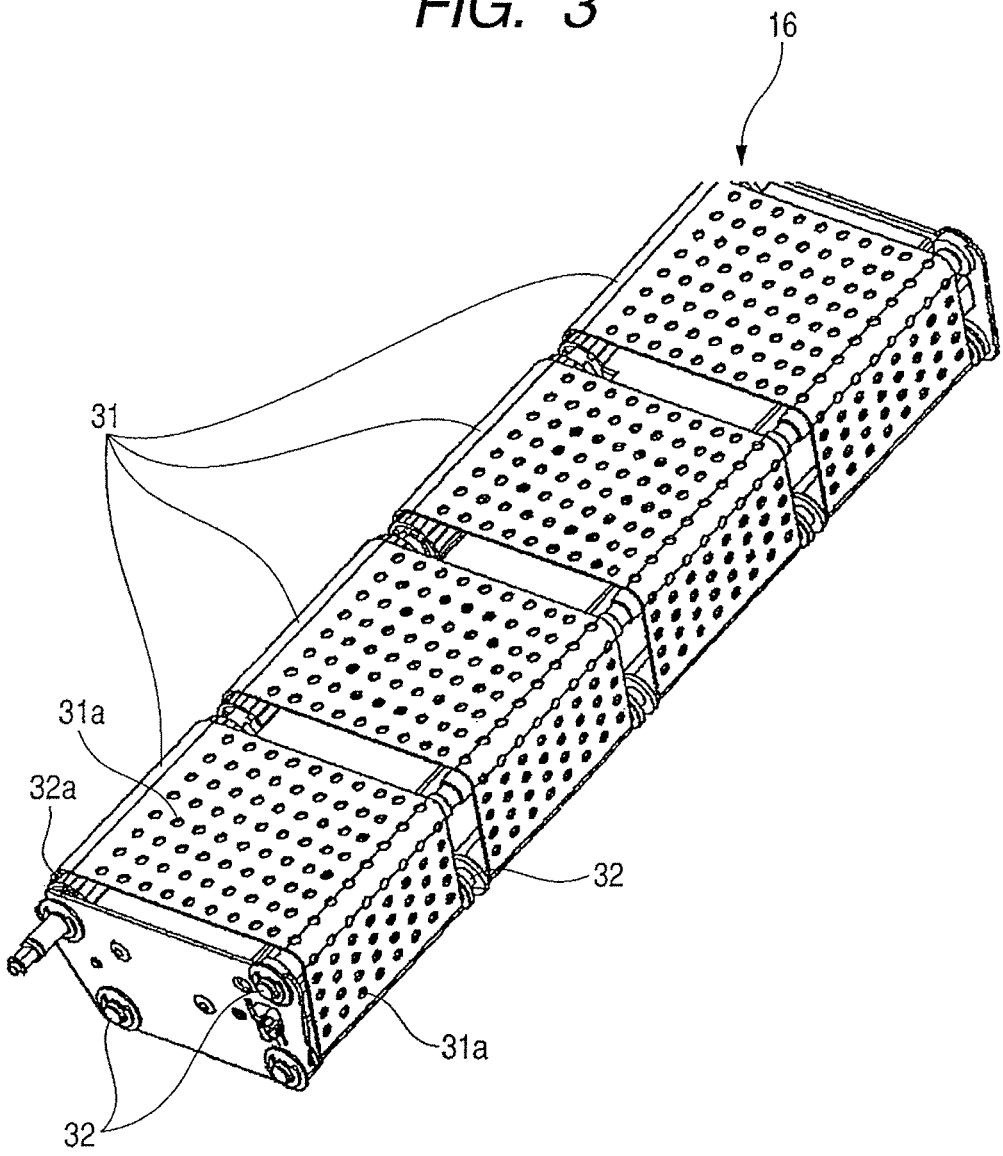
FIG. 3 illustrates a structure of the conveyor belt unit.
Figure 4:
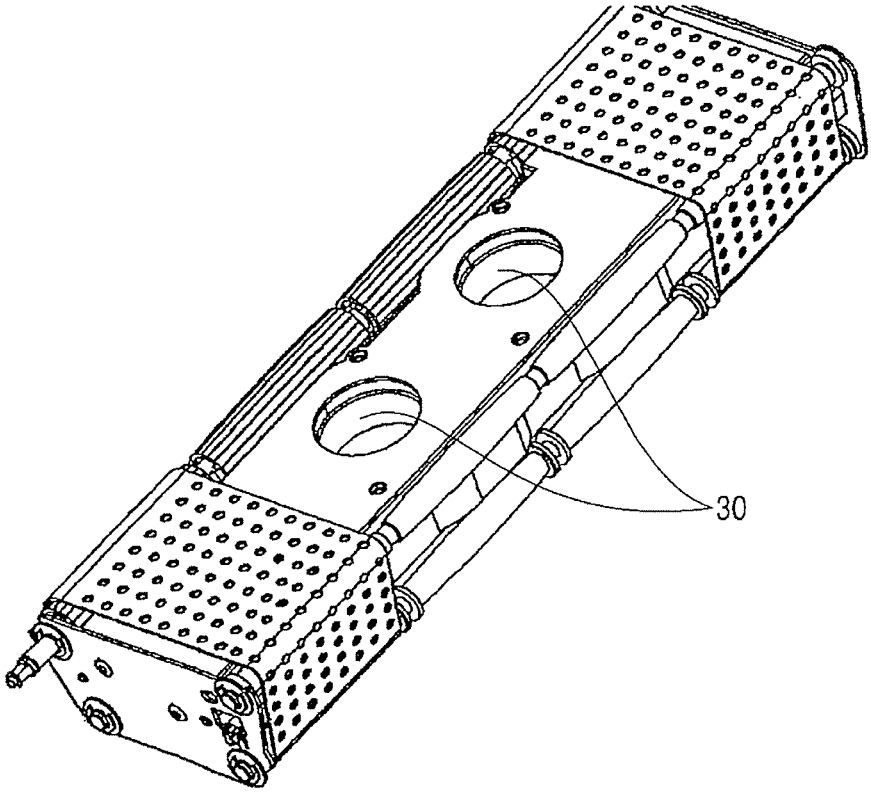
FIG. 4 illustrates a conveying fan which constitutes the conveyor belt unit.

As illustrated in FIG. 3, the conveyor belt unit 16 includes four suspension rollers 32 and 32*a*, and four sheet conveyor belts 31 which are suspended by the four rollers 32 and 32*a*, and conveying fans 30 provided inside the sheet conveyor belt 31 (see FIG. 4). The conveying fans 30 sucks air for adsorbing the sheet to the conveyor belt 31. FIG. 4 is a perspective view of the conveyor belt unit 16 in a state where the sheet conveyor belts 31 are removed.

One suspension roller 32*a* among the four suspension rollers 32 and 32*a* is a drive roller, and has a knurled shape so as to reliably rotate the sheet conveyor belt 31 serving as the sheet transport unit. The sheet conveyor belt 31 has multiple holes 31*a* formed therein so that attraction is enabled by the conveying fan 30 serving as the adsorbing unit provided inside the sheet conveyor belt 31. By providing the plurality of holes 31*a*, it is possible to stably adsorb and transport the sheet.

Figure 5:
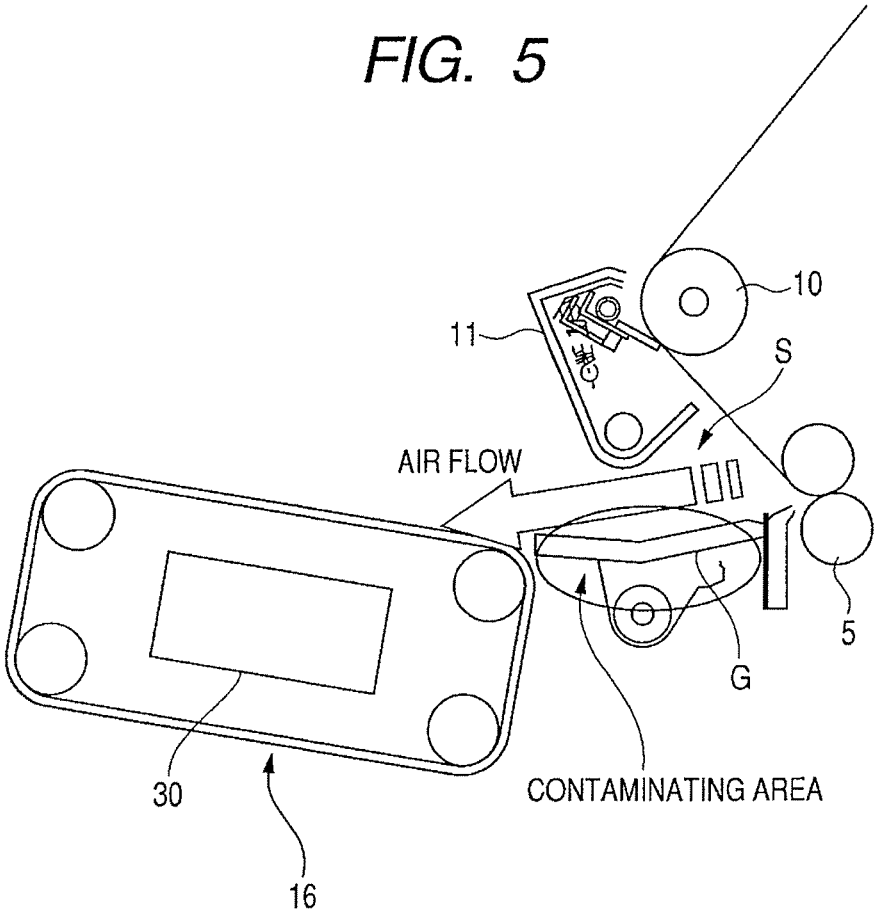
FIG. 5 illustrates an air flow generated by an adsorbability of the conveying fan.

When the sheet is adsorbed and transported by the conveyor belt unit 16, in a case where the adsorbability (suction force) of the conveying fan 30 is large, the air flow from the carrying space side to the conveying fan 30 is generated as illustrated in FIG. 5. When the air flow is generated, for example, when the full-color toner image is formed, in a case where the toner image formed on the intermediate transfer belt 8 is present at the position where the toner image faces the carrying space S, there is a fear that the toner on the intermediate transfer belt 8 scatters in the carrying space S, which may contaminate the conveying guide G (sheet transport path).

In this embodiment, the adsorbability of the conveying fan 30 is set to be variable. In the case where the toner image formed on the intermediate transfer belt 8 is present at the position where the toner image faces the carrying space S, the conveying fan 30 is stopped, thereby removing (reducing) the adsorbability. In a case where the toner image is present in the carrying space S, the adsorbability of the conveying fan 30 is removed, thereby preventing scattering of the toner and contamination of the sheet transport path.

In this embodiment, the position of the toner image formed on the intermediate transfer belt 8 can be recognized based on the elapse of time from the time when the reference signal (TOP signal) from the detector 9 is transmitted. Based on the elapse of time from the time when the reference signal from the detector 9 is transmitted, in a case where the toner image formed on the intermediate transfer belt 8 is present in the carrying space S, the fan drive motor 30A is stopped by the control unit 62 so as to remove the adsorbability of the conveying fan 30.

Next, referring to FIGS. 6A to 6C, description will be made of the control of the adsorbability by the control unit 62 according to this embodiment in the case where the full-color toner image is formed.

Figure 6A:
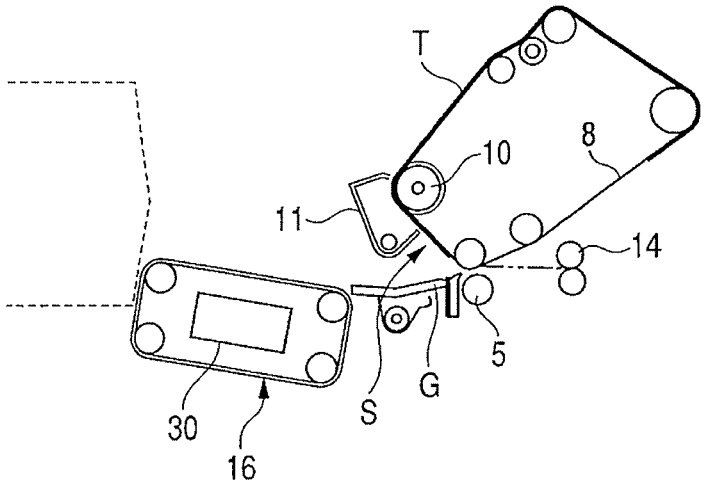
FIG. 6A illustrates control of the adsorbability by a control unit provided to the color laser printer in a case where a full-color toner image is formed.

FIG. 6A illustrates a state where a toner image T transferred onto the intermediate transfer belt 8 is present in the carrying space S in the case where the full-color toner image is formed. In this case, the control unit 62 stops the fan drive motor 30A so as to stop the conveying fan 30.

Figure 6B:
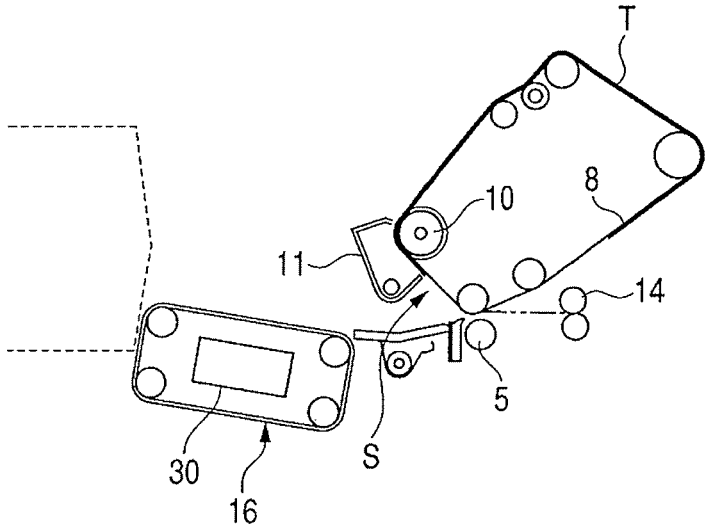
FIG. 6B illustrates the control of the adsorbability by the control unit provided to the color laser printer in the case where the full-color toner image is formed.
Figure 6C:
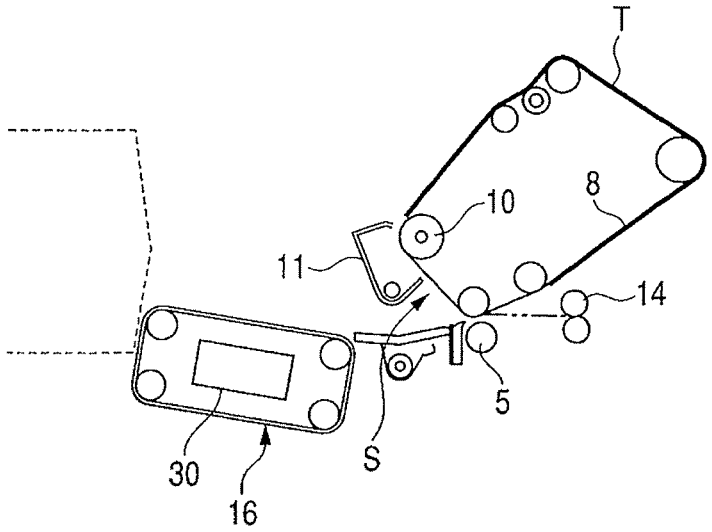
FIG. 6C illustrates the control of the adsorbability by the control unit provided to the color laser printer in the case where the full-color toner image is formed.

FIGS. 6B and 6C illustrate a state where the toner image T formed on the intermediate transfer belt 8 has passed through the carrying space S. Also in this case, the drive of the fan drive motor 30A is continuously stopped by the control unit 62 so as to remove the adsorbability of the conveying fan 30. It should be noted that when the toner image is transferred onto the intermediate transfer belt 8, the secondary transfer roller 5 is moved to a position spaced apart from the intermediate transfer belt 8.

In this case, when the full-color toner image is formed, the operations illustrated in FIGS. 6A to 6C are repeated. Specifically, in the case of forming the full-color toner image, when the toner image for the first color is transferred onto the intermediate transfer belt 8 and then the toner image for the second color is transferred onto the intermediate transfer belt 8, a trailing end portion of the toner image T is present in the carrying space S as illustrated in FIG. 6A. After that, in association with the rotation of the intermediate transfer belt 8, the trailing end portion of the toner image T formed on the first surface passes through the carrying space S as illustrated in FIGS. 6B and 6C.

Then, when the toner image for the third color is transferred onto the intermediate transfer belt 8, each trailing end portion of the toner images T for the first color and the second color is present in the carrying space S as illustrated in FIG. 6A. After that, in association with the rotation of the intermediate transfer belt 8, each trailing end portion of the toner images T for the first color and the second color passes through the carrying spaces S as illustrated in FIGS. 6B and 6C.

When the toner image for the fourth color is transferred onto the intermediate transfer belt 8, the trailing end portions of the toner images T for the first color to the third color are present in the carrying space S as illustrated in FIG. 6A. After that, in association with the rotation of the intermediate transfer belt 8, the trailing end portions of the toner images T for the first color to the third color pass through the carrying space S as illustrated in FIGS. 6B and 6C.

In this embodiment, the control unit 62 stops the conveying fan 30 immediately before the leading end of the toner image for the first color transferred onto the intermediate transfer belt 8 reaches the carrying space S. Then, as illustrated in FIG. 6B, after each trailing end portion of the toner images T for the first to third colors has passed through the carrying space S, the toner images T are not present in the carrying space S, so the control unit 62 controls the fan drive motor 30A so that the adsorbability of the conveying fan 30 is restored to an adsorbability necessary for adsorbing the sheet.

By restoration of the adsorbability of the conveying fan 30 at the above-mentioned timing, when the sheet reaches the conveyor belt unit 16 after the four color toner images are transferred onto the sheet by the secondary transfer portion, the intermediate transfer belt 8 exerts a sufficient adsorbability.

The control unit 62 performs control of the adsorbability of the conveying fan 30 in response to the reference signal (TOP signal) from the detector 9.

Figure 7:
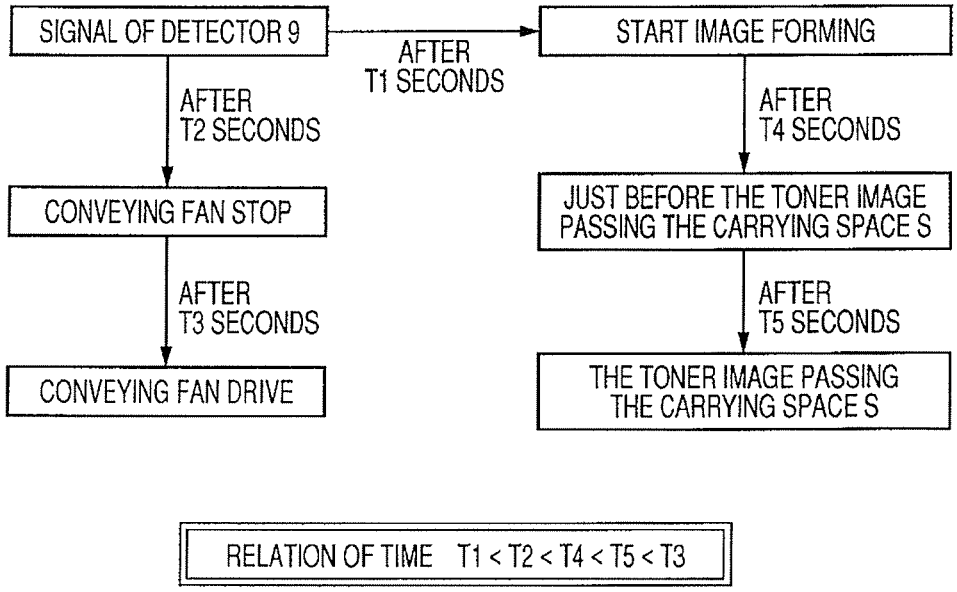
FIG. 7 illustrates an operation for control of the conveying fan.
Figure 8:
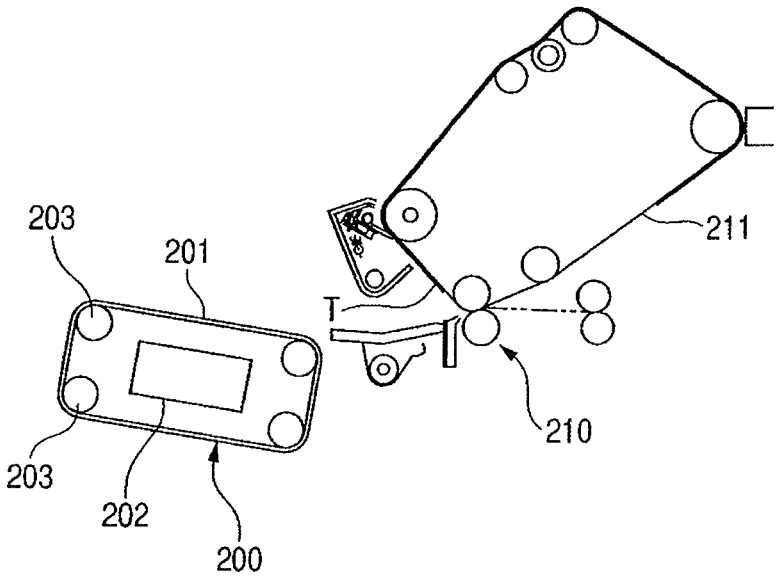
FIG. 8 RELATED ART
FIG. 8 illustrates a structure of a related sheet transport apparatus.

FIG. 7 is a diagram for illustrating a relationship between the operation of controlling the conveying fan 30 by the control unit 62 and the position of the toner image on the intermediate transfer belt 8.

As illustrated in FIG. 7, the control unit 62 controls the exposure system 4 so as to start image formation after T1 seconds in response to the reference signal (TOP signal) from the detector 9. After receiving the reference signal (TOP signal) from the detector 9, the control unit 62 controls the fan drive motor 30A so as to stop the conveying fan 30 after time T2 (>time T1) seconds. The time T2 is shorter than the time T4 which is immediately before the time when the toner image T for the first color reaches the carrying space S (T4>T2).

A time between the time when the control unit 62 receives the reference signal (TOP signal) from the detector 9 and the time when the toner images T for the first to third colors pass through the carrying space S as illustrated in FIG. 6B, is represented as T5. The control unit 62 controls the fan drive motor 30A to drive the conveying fan 30 after the toner images have passed through the carrying space S, that is, after the elapse of a time T3 which is larger than a time T5.

Figure 9:
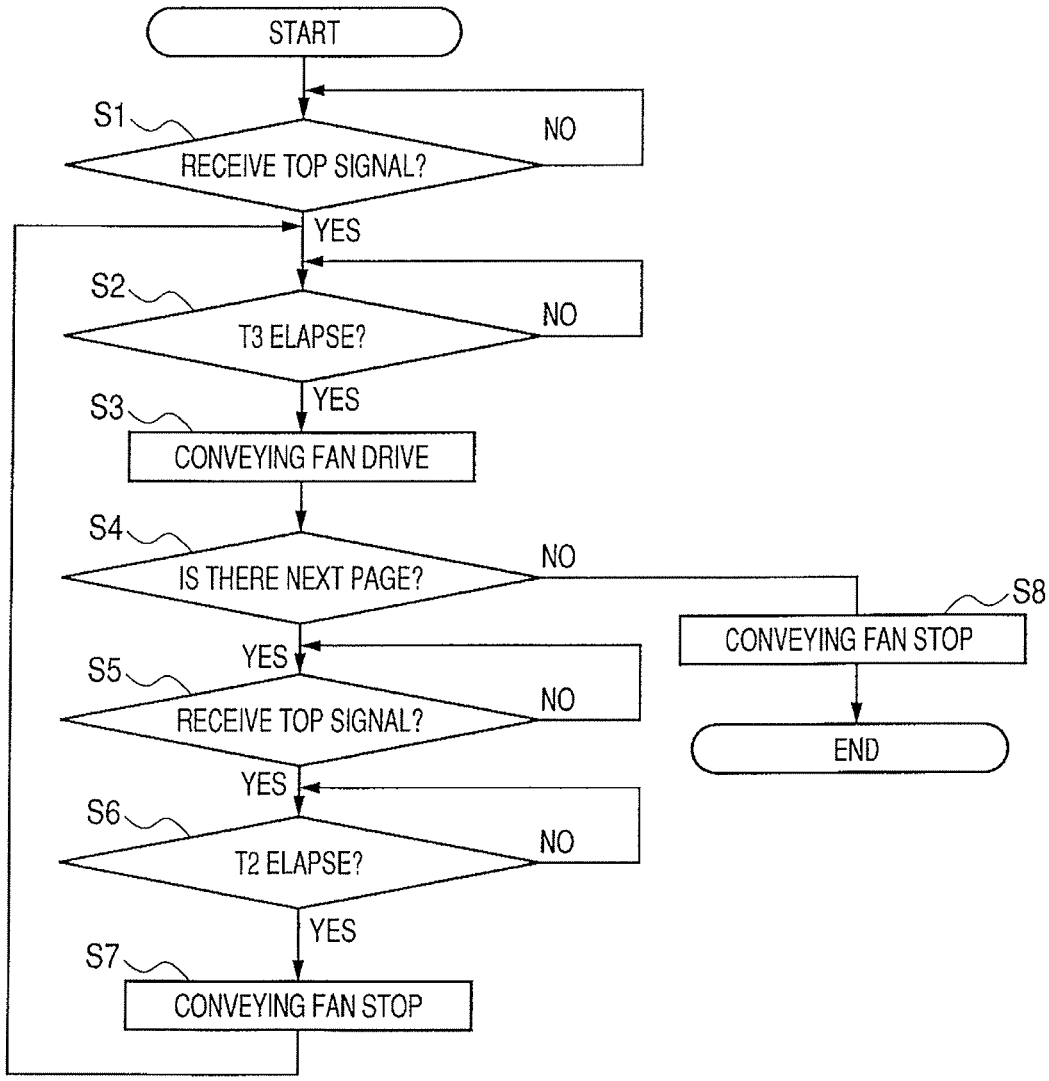
FIG. 9 illustrates a flowchart for the control of the conveying fan by the control unit.

FIG. 9 is a flowchart illustrating the operation of controlling the conveying fan 30 by the control unit 62. In FIG. 9, the control unit 62 determines whether or not the reference signal (TOP signal) of the detector 9 is received in Step 1 (hereinafter, a step is represented as "S").

After receiving the reference signal (TOP signal) from the detector 9, the control unit 62 drives the conveying fan 30 after the elapse of the time T3 from the time when the reference signal (TOP signal) is received from the detector 9 (S2 and S3). The time T3 is set as a time after the toner images T for the first to third colors has passed through the carrying space S after the reference signal is received as illustrated in FIG. 6B.

Then, the control unit 62 determines whether or not there is a subsequent page (S4). In a case where there is the subsequent page, the control unit 62 determines whether or not the reference signal related to the subsequent page has been received (S5).

Upon reception of the reference signal (TOP signal) related to the subsequent page from the detector 9, the control unit 62 stops the conveying fan 30 after the elapse of the time T2 after the reference signal (TOP signal) related to the subsequent page is received. The time T2 is set as a time before the toner image for the first color related to the subsequent page reaches the carrying space S after the reference signal (TOP signal) related to the subsequent page is received, that is, a time before the toner image for the first color faces the conveyor belt.

Then, after the elapse of the time T3 after receiving the reference signal (TOP signal) related to the subsequent page, the control unit 62 drives the conveying fan 30 (S2).

In a case where it is determined that there is not the subsequent page in S4, the control unit 62 stops the conveying fan 30 after the elapse of time sufficient for the conveyor belt unit 16 to transport the sheet to the fixing portion 6 (S8).

The conveying fan 30 is stopped before the toner image primarily transferred onto the intermediate transfer belt reaches the position at which the toner image faces the sheet conveyor belt 31, thereby enabling reduction in scattering of the toner image. As a result, it is possible to provide a sheet having a high-quality image formed thereon without adhesion of stain to the sheet. It is also possible to reduce contamination due to toner within the apparatus main body.

In this embodiment, description has been made of the mode in which the conveying fan 30 is stopped in the case where the toner image is present in the carrying space S. Alternatively, in the case where the toner image is present in the carrying space S, it is also possible to control the conveying fan 30 to operate in a state where the adsorbability is reduced to an adsorbability necessary for adsorbing the sheet. In this case, by application of a voltage of 12 V to, for example, the conveying fan 30 having a rating of 24 V, by the control unit 62, the adsorbability of the conveying fan 30 may be reduced.

In the embodiment, illustrated is the mode in which the timing for changing the drive of the conveying fan 30 is determined based on the time after the control unit 62 receives the reference signal (TOP signal) from the detector 9. Alternatively, a detector for detecting a position of a toner image transferred onto the intermediate transfer belt 8 may be provided, and the control unit 62 may control the drive of the conveying fan 30 in response to a signal from the detector.

Depending on types of sheets (materials), for example, in a case where a thick sheet which requires a large amount of heat is used, there is adopted a method of increasing the amount of heat to be given per unit time by reducing a fixing speed of the fixing portion when the image is fixed onto the sheet. In other words, the imaging operation (primary transfer) onto the intermediate transfer belt is performed at a normal speed. After the four-color toner image is primarily transferred onto the intermediate transfer belt 8, the circumferential speed of the intermediate transfer belt 8 is reduced immediately before the toner image is transferred onto the sheet. In this case, the circumferential speed of the intermediate transfer belt 8 is low, so the toner image is more liable to be scattered in the carrying space. Also in this case (condition), when the toner image is present in the carrying space S, the adsorbability of the conveying fan 30 is reduced, thereby preventing adhesion of stain to the transport path.

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2006-212613, filed Aug. 3, 2006, which is hereby incorporated by reference herein in its entirety.

What is claimed is:

1. An image forming apparatus, comprising:

an image carrying unit on which a toner image is carried;

a transfer unit that transfers a toner image carried by the image carrying unit onto a sheet at a transferring position;

a sheet conveyor unit that conveys the sheet having the toner image transferred thereto by the transfer unit;

a suction device that generates a suction force so as to absorb the sheet to the sheet conveyor unit while the sheet conveyor unit conveys the sheet, the suction device being changeable between a first state to absorb the sheet to the sheet conveyor unit and a second state to stop a sheet adsorbing operation, and wherein the toner image carried by the image carrying unit is transferred onto the sheet after the toner image passes through a position where the toner image faces the sheet conveyor unit;

an obtaining unit that obtains information regarding a location of the toner image on the image carrying unit; and a controller configured to control the suction device based on the information regarding the location of the toner image obtained by the obtaining unit so that the suction device is changed from the first state to the second state before a leading end of the toner image carried by the image carrying unit reaches the position where the toner image faces the sheet conveyor unit and the suction device is changed from the second state to the first state after a trailing end of the toner image passes through the position where the toner image faces the sheet conveyor unit.

2. An image forming apparatus according to claim 1, further comprising:

a photosensitive member; and a primary transfer portion that transfers the toner image onto the image carrying unit so that the toner image formed on the photosensitive member drum is carried on the image carrying unit, wherein:

the toner image for a first color formed on the photosensitive member is transferred onto the image carrying unit, and then the image carrying unit carrying the toner image for the first color rotates so that the toner image for a second color formed on the photosensitive member is transferred onto the image carrying unit; and during rotation of the image carrying unit carrying the toner image for the first color, the toner image formed on the image carrying unit is present at the position where the toner image faces the sheet conveyor unit.

3. An image forming apparatus according to claim 1, further comprising:

a cleaning portion that cleans the image carrying unit; and a conveying guide provided between the transfer unit and the sheet conveyor unit, that guides the sheet having the toner image transferred thereto by the transfer unit to the sheet conveyor unit, wherein the sheet having the toner image transferred thereto by the transfer unit passes through a carrying space formed between the cleaning portion and the conveying guide and is transported to the sheet conveyor unit; and when the toner image carried by the image carrying unit is present in the carrying space, the toner image carried by the image carrying unit faces the sheet conveyor unit.

4. An image forming apparatus according to claim 1, further comprising:

a fixing portion that is disposed on a downstream of the sheet conveyor unit in a sheet conveying direction and fixes the toner image on the sheet.

5. An image forming apparatus according to claim 1, wherein the suction device is changed from the second state to the first state before the sheet reaches the sheet conveyor unit.

6. An image forming apparatus according to claim 1, wherein the obtaining unit includes a detector that detects a detection target provided on the image carrying unit, wherein the controller is configured to control the suction device based on a detection result of the detector.

7. An image forming apparatus, comprising:

an image carrying unit on which a toner image is carried;

a transfer unit that transfers a toner image carried by the image carrying unit onto a sheet at a transferring position;

a sheet conveyor unit that conveys the sheet having the toner image transferred thereto by the transfer unit;

a suction device that generates a suction force so as to absorb the sheet to the sheet conveyor unit while the sheet conveyor unit conveys the sheet, the suction device being changeable between a first state to absorb the sheet to the sheet conveyor unit and a second state to reduce the suction force compared with the first state, and wherein the toner image carried by the image carrying unit is transferred onto the sheet after the toner image passes through a position where the toner image faces the sheet conveyor unit;

an obtaining unit that obtains information regarding a location of the toner image on the image carrying unit; and a controller configured to control the suction device based on the information regarding the location of the toner image obtained by the obtaining unit so that the suction device is changed from the first state to the second state before a leading end of the toner image carried by the image carrying unit reaches the position where the toner image faces the sheet conveyor unit and the suction device is changed from the second state to the first state after a trailing end of the toner image passes through the position where the toner image faces the sheet conveyor unit.

8. An image forming apparatus according to claim 7, further comprising:

a photosensitive member; and a primary transfer portion that transfers the toner image onto the image carrying unit so that the toner image formed on the photosensitive member is carried on the image carrying unit, wherein:

the toner image for a first color formed on the photosensitive member is transferred onto the image carrying unit, and then the image carrying unit carrying the toner image for the first color rotates so that the toner image for a second color formed on the photosensitive member is transferred onto the image carrying unit; and during rotation of the image carrying unit carrying the toner image for the first color, the toner image formed on the image carrying unit is present at the position where the toner image faces the sheet conveyor unit.

9. An image forming apparatus according to claim 7, further comprising:

a cleaning portion that cleans the image carrying unit; and a conveying guide provided between the transfer unit and the sheet conveyor unit, that guides the sheet having the toner image transferred thereto by the transfer unit to the sheet conveyor unit, wherein the sheet having the toner image transferred thereto by the transfer unit passes through a carrying space formed between the cleaning portion and the conveying guide and is transported to the sheet conveyor unit; and when the toner image carried by the image carrying unit is present in the carrying space, the toner image carried by the image carrying unit faces the sheet conveyor unit.

10. An image forming apparatus according to claim 7, further comprising:

a fixing portion that is disposed on a downstream of the sheet conveyor unit in a sheet conveying direction and fixes the toner image on the sheet.

11. An image forming apparatus according to claim 7, wherein the suction device is changed from the second state to the first state before the sheet reaches the sheet conveyor unit.

12. An image forming apparatus according to claim 7, wherein the obtaining unit includes a detector that detects a detection target provided on the image carrying unit, wherein the controller is configured to control the suction device based on a detection result of the detector.

* * * * *